US005467116A

United States Patent [19]

Nakamura et al.

[11] Patent Number: 5,467,116

[45] Date of Patent: Nov. 14, 1995

[54] INK JET PRINTER WITH DEVICE FOR ALIGNING AN INK CARTRIDGE

[75] Inventors: Shinya Nakamura; Tsutomu Yamaguchi, both of Shizuoka, Japan; Steven J. Dietl; Donald M. Stevens, both of Webster, N.Y.

[73] Assignees: Kabushiki Kaisha Tec, Shizuoka, Japan; Xerox Corporation, Webster, N.Y.

[21] Appl. No.: 64,423

[22] Filed: May 21, 1993

[30] Foreign Application Priority Data

| | | | |
|---|---|---|---|
| May 22, 1992 | [JP] | Japan | 4-130513 |
| May 22, 1992 | [JP] | Japan | 4-130514 |
| Jun. 12, 1992 | [JP] | Japan | 4-153329 |

[51] Int. Cl.[6] ..... B41J 2/14

[52] U.S. Cl. ..... 347/50; 347/87; 400/352; 439/248

[58] Field of Search ..... 347/37, 39, 49, 347/50, 86, 87, 8, 41; 400/175, 352, 353, 355, 357; 439/64, 140, 248

[56] References Cited

U.S. PATENT DOCUMENTS

| | | | |
|---|---|---|---|
| 4,635,080 | 1/1987 | Watanabe | 347/50 |
| 4,806,106 | 2/1989 | Mebane et al. | 347/50 |
| 4,857,005 | 8/1989 | Kikuchi et al. | 439/140 |
| 4,872,026 | 10/1989 | Rasmussen et al. | 347/56 |
| 4,907,018 | 3/1990 | Pinkerpell et al. | 347/50 X |
| 4,965,608 | 10/1990 | Shinohara et al. | 347/12 |
| 5,070,345 | 12/1991 | Lahut et al. | 347/41 |
| 5,138,342 | 8/1992 | Kurata et al. | 347/50 |
| 5,212,502 | 5/1993 | Bowling | 347/49 |
| 5,289,212 | 2/1994 | Carlotta | 347/87 |
| 5,317,339 | 5/1994 | Braun et al. | 347/87 |

FOREIGN PATENT DOCUMENTS

| | | | |
|---|---|---|---|
| 2484917 | 12/1981 | France . | |
| 60-234860 | 11/1985 | Japan . | |
| 60-262651 | 12/1985 | Japan . | |
| 63-316870 | 12/1988 | Japan . | |
| 4-141427 | 5/1992 | Japan | 347/49 |

OTHER PUBLICATIONS

Patent Abstracts of Japan, Jul. 7, 1990, JP-A-2-178050, Makoto Kashimura, et al., Ink Jet Recording Head and Ink Jet Recording Device with Head Mounting Device.

Patent Abstracts of Japan, Jul. 24, 1990, JP-A-2-188246, Makoto Kashimura, et al., Integral Ink Tank-Type Recording Head Cartridge, Carriage Loaded with Same Cartridge, and Ink Jet Recorder Using Them.

Patent Abstracts of Japan, Apr. 26, 1991, JP-A-3-101949, Yasuhiro Unosawa, et al., Ink Jet Recording Head and Carrier Moving with the Head Loaded Thereon.

*Primary Examiner*—Benjamin R. Fuller
*Assistant Examiner*—John E. Barlow, Jr.
*Attorney, Agent, or Firm*—Oblon, Spivak, McClelland, Maier & Neustadt

[57] ABSTRACT

An ink jet printer in which an ink cartridge is used. The cartridge includes an ink tank and a head base plate which has an ink jet head including a plurality of ink discharging nozzles. A carriage for mounting an ink cartridge thereon has at least three projections for individually contacting with at least three portions of the head base plate. The head base plate is pressed against the projections to fix the ink cartridge to the carriage thereby to position ink discharging nozzles of the ink jet head accurately at predetermined positions with respect to a recording medium so that ink may be jetted in a predetermined direction with certainty from the ink jet head to the recording medium.

18 Claims, 14 Drawing Sheets

INK JET PRINTER WITH DEVICE FOR ALIGNING AN INK CARTRIDGE

BACKGROUND OF THE INVENTION

1. Field of the Invention

This invention relates to an ink jet printer wherein ink drops are selectively jetted toward a recording medium to effect printing, and more particularly to an ink jet printer of the structure wherein an ink cartridge including an ink jet head and an ink tank which are formed as a unit is removably mounted on a carriage.

2. Description of the Related Art

An ink jet printer is already known wherein an ink cartridge including an ink tank and an ink jet head which are formed as a unit is removably mounted on a carriage which is mounted for back and forth translational movement on a body case and ink is jetted from nozzles of the ink jet head during movement of the carriage to effect printing.

In an ink jet printer of the type mentioned, due to the structure that the ink jet head is removably mounted on the carriage on the body case, a structure for electrically connecting a printing control circuit provided on the body case side and the ink jet head to each other is required. According to an exemplary one of such electric connection structures, a connector on the market is mounted on the carriage and connected to the printing control circuit while pin terminals are provided on the ink cartridge and connected to the ink jet head, and when the ink cartridge is mounted onto the carriage, the pin terminals on the ink cartridge side are connected to the connector on the carriage side. The connection structure, however, requires a structure for relative movement between the pin terminals and the connector since it sometimes occurs that, upon mounting of the ink cartridge, the connector must be moved relative to the pin terminals due to an error in assembly of parts. Such structure for relative movement complicates the structure of the ink jet printer and raises the cost of parts.

Thus, such a connection structure as shown in FIG. 22 has been proposed. In the following, the connection structure will be described with reference to FIG. 22. A rubber pad 101 is carried on a carriage (not shown) mounted for back and forth translational movement on a body case (not shown). A large number of projections 102 are formed on a surface of the rubber pad 101. A flexible cable 103 made of a vinyl chloride material is carried in an opposing relationship to the rubber pad 101 on the carriage. A large number of connection portions 104 are formed from a thin film metal in an opposing relationship to the projections 102 on the flexible cable 103 such that they are swollen toward the surface of the rubber pad 101. The connection portions 104 are connected to a driving section (not shown) by way of connection lines 105 formed on the flexible cable 103. A connection pattern 106 is formed from metal foil on one face of an ink cartridge (not shown) removably carried on the carriage. The connection pattern 106 has a large number of terminals 107 for contacting with the connection portions 104. The terminals 107 are connected to heat generation elements provided in the insides of nozzles (not shown) of the ink jet head.

Accordingly, when the ink cartridge is mounted onto the carriage, the connection portions 104 connected to the driving section are connected to the terminals 107 of the ink jet head. Here, since the projection heights of the connection portions 104 are not uniform and they do not contact fully with the terminals 107, the connection portions 104 are pressed against the terminals 107 by the projections 102 of the rubber pad 101. Upon printing, a voltage is applied to a selected one or ones of the terminals 107 to cause the heat generation element or elements connected to the selected terminal or terminals 7 to boil ink in the nozzle or nozzles, and the ink is jetted from the nozzle or nozzles by the pressure or pressures raised as a result of such boiling. Ink is supplied from an ink tank (not shown) to each of the nozzles.

Problems of the prior art ink jet printer will be described subsequently. As a conventional method of mounting an ink cartridge onto a carriage, a method of positioning and securing an outer shell of the ink cartridge to the carriage is employed commonly. However, with such method, it sometimes occurs that positioning of the ink jet head and nozzles with respect to the ink cartridge is inaccurate or the ink cartridge is displaced out of position when it is mounted onto the carriage, and accordingly, a dispersion is liable to be caused with the positions of the nozzles of the ink jet head with respect to the recording medium. In this instance, ink will not be jetted in the correct direction, and accordingly, there is a problem that the print quality is deteriorated.

Further, where such a structure as shown in FIG. 22 is employed as a structure for electrically connecting a printing control circuit and an ink jet head to each other, since the amount of deformation of the projections 102 of the rubber pad 101 is small, if there is a dispersion with the mounting position of the ink jet head with respect to the carriage, then there is a problem that it is difficult to contact all of the connection portions 104 under pressure with the terminals 107 with certainty. Besides, since the rubber pad 101 is required, the number of parts is great as much and a high cost is required.

SUMMARY OF THE INVENTION

It is an object of the present invention to provide an ink jet printer wherein ink can be jetted in a predetermined direction from an ink jet head with certainty only by mounting an ink cartridge onto a carriage.

It is another object of the present invention to provide an ink jet printer wherein an ink jet head can be mounted at an accurate position on a carriage with certainty.

It is a further object of the present invention to provide an ink jet printer wherein all connection portions can be contacted with certainty with contacts on the ink cartridge side.

It is a still further object of the present invention to provide an ink jet head of a construction suitable to drive heat generation elements corresponding to a plurality of discharging nozzles of an ink jet head in a time division condition in a plurality of groups.

In order to attain the objects described above, according to an aspect of the present invention, there is provided an ink jet printer in which an ink cartridge including an ink tank and a head base plate which has an ink jet head including a plurality of ink discharging means is used, which comprises printing means including a carriage shaft extending in a main printing direction and a carriage mounted for sliding movement on the carriage shaft and having the ink cartridge carried thereon, the printing means performing printing in the main printing direction on a recording medium with ink which is selectively discharged from the ink discharging means of the ink jet head, at least three projections provided on the carriage for individually contacting with at least three portions of the head base plate to position the ink discharging means of the ink jet head at predetermined positions, and pressurizing means provided on the carriage for pressing the head base plate against the projections. With the ink jet printer, the ink cartridge is mounted fixedly on the carriage as the projections are pressed against the head base plate, and consequently, the ink discharging means of the ink jet head are positioned at the predetermined positions with respect to the recording medium. Accordingly, ink is jetted in the predetermined direction with certainty from the ink jet head.

According to another aspect of the present invention, there is provided an ink jet printer, which comprises a carriage mounted for sliding movement on a carriage shaft, an ink cartridge including an ink tank and a head base plate coupled to the ink tank and having an ink jet having a plurality of ink discharging means for individually discharging ink therefrom and a plurality of contacts individually connected to the ink discharging means, a plurality of contact elements provided on the carriage for resiliently contacting with the contacts of the head base plate, a support member provided on the carriage and having at least three projections for individually contacting with at least three portions of the head base plate and a positioning portion for engaging with the head base plate, and pressurizing means provided on the carriage for pressurizing the head base plate toward the support member side. With the ink jet printer, since the head base plate is pressed against the support member on the carriage, the ink cartridge is fixed to the carriage with the connection elements contacted accurately with the contacts of the head base plate. In this instance, the head base plate is positioned by the positioning portion while it is positioned in the direction of movement of the carriage accurately by the three projections of the support member. The ink jet head formed integrally on the head base positioned accurately in this manner is thus positioned accurately, and consequently, ink is jetted in the predetermined direction with certainty from the ink jet head.

According to a further aspect of the present invention, there is provided an ink jet printer, which comprises a carriage mounted for back and forth movement, an ink cartridge removably mounted on the carriage and including an ink tank and an ink jet head coupled integrally to the ink tank and having a plurality of ink discharging means for individually discharging ink from nozzles thereof, a wiring board provided on the ink cartridge and having thereon a plurality of contacts individually connected to the ink discharging means, and a connector mounted on the carriage and including an insulating member and a plurality of connection elements each formed from an elastic metal plate and secured at portions thereof to the insulating member for resiliently contacting with the contacts. With the ink jet printer, when the ink cartridge is to be mounted onto the carriage, the amount of deformation of the connection elements connected to the contacts of the head base plate is very great. Consequently, even if the connection elements are not arranged uniformly but arranged irregularly, or even if the contacts of the head base plate have some error in their flatness, the connection elements can be contacted with certainty with the contacts on the ink cartridge side.

BRIEF DESCRIPTION OF THE DRAWINGS

These and other objects and advantages of this invention will become more apparent and more readily appreciated from the following detailed description of the presently preferred exemplary embodiments of the invention, taken in conjunction with the accompanying drawings, wherein like reference numerals throughout the various figures denote like structure elements and wherein.

DETAILED DESCRIPTION OF THE PREFERRED EMBODIMENTS

Figure 4:
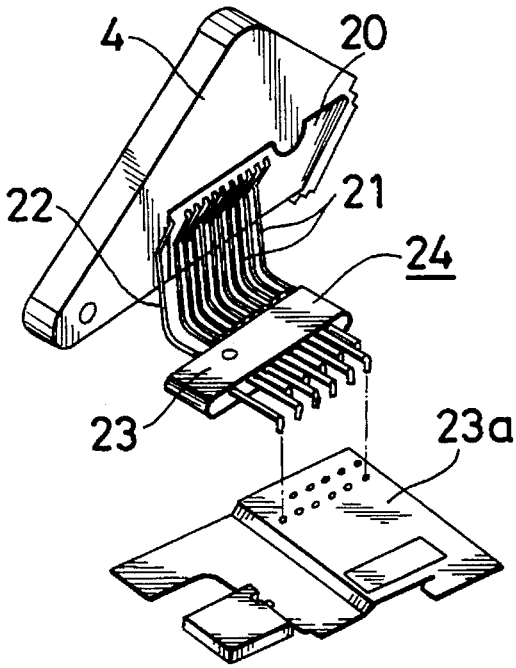
FIG. 4 is a perspective view illustrating a relationship between a wiring board provided on the head base plate and a connector.
Figure 5:
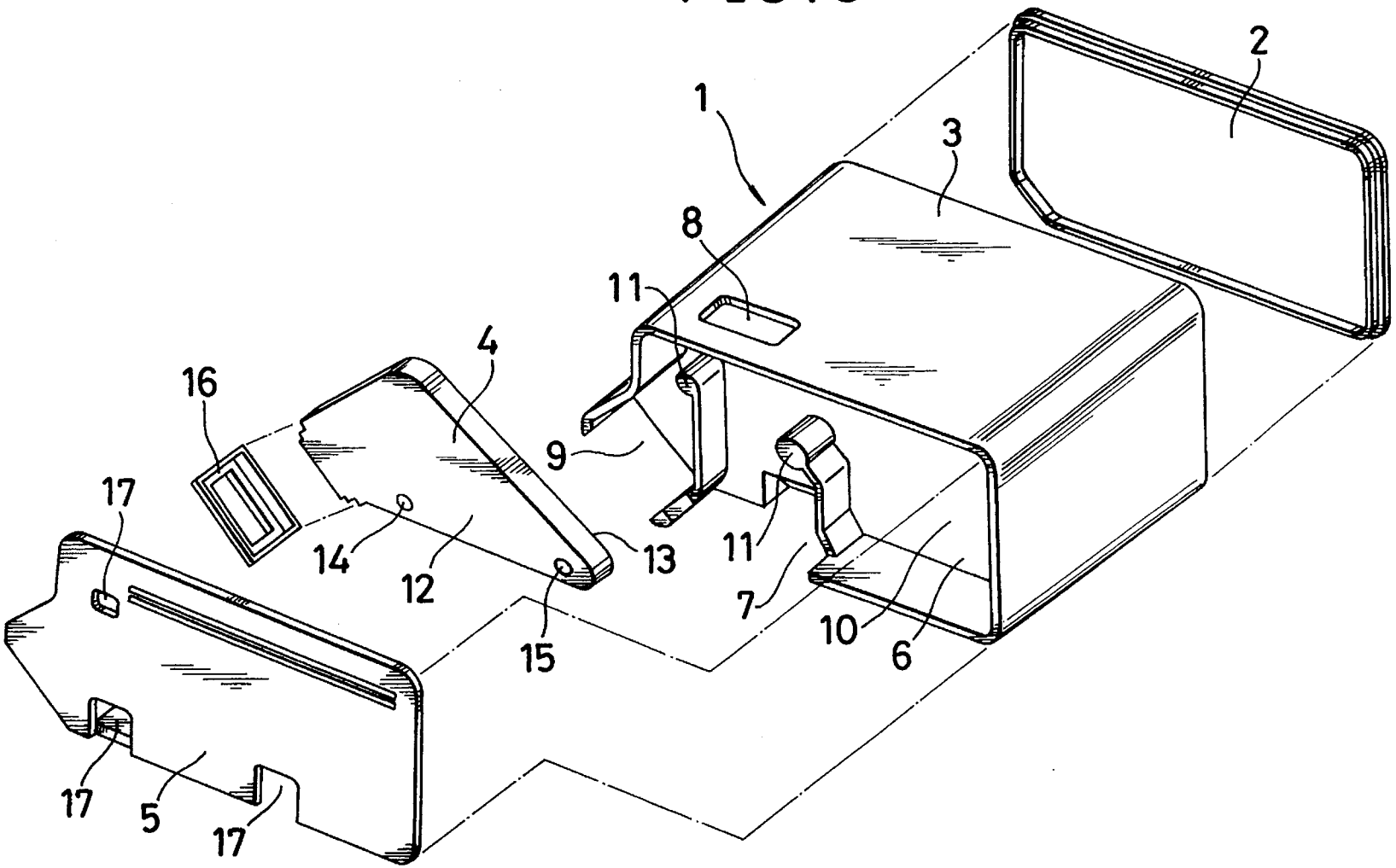
FIG. 5 is an exploded perspective view of an ink cartridge.
Figure 8:
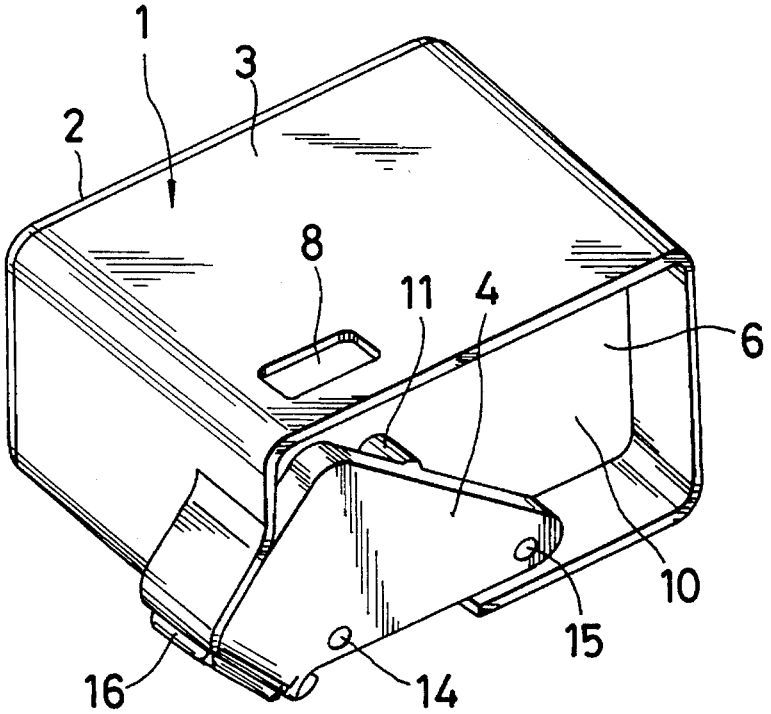
FIG. 8 is a perspective view showing the inside structure of the ink cartridge.
Figure 9:
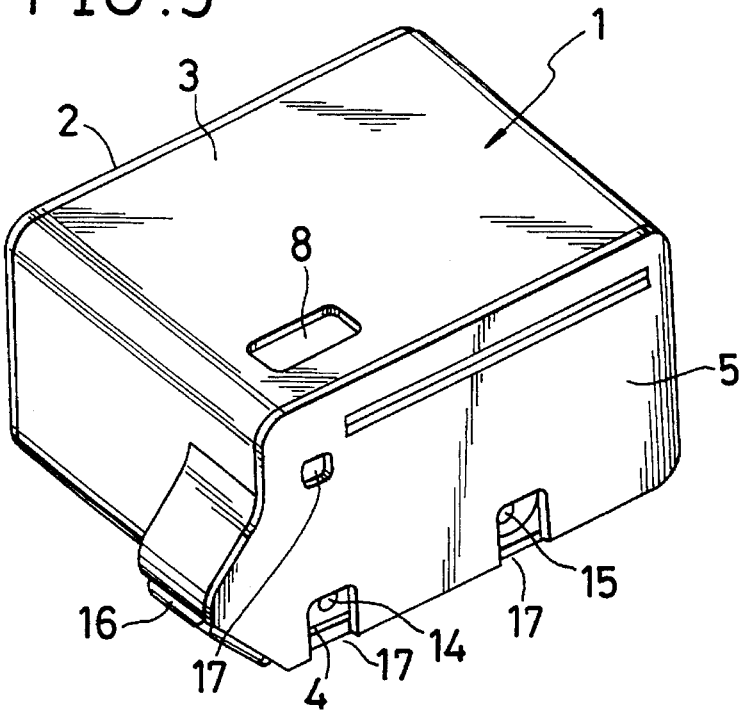
FIG. 9 is a perspective view of the ink cartridge.

A first embodiment of the present invention will be described with reference to FIGS. 1 to 13. Referring first to FIGS. 5, 8 and 9, there is shown the structure of an ink cartridge 1. The ink cartridge 1 includes, as shown in FIG. 5, an ink tank 3 having a cap 2 on a side surface thereof and having ink accommodated therein, a head base plate 4 made of a metal, and a cartridge cover 5 coupled to the ink tank 3 and the head base plate 4. A recess 6 is formed on a surface of the ink tank 3 remote from the cap 2, and openings 7, 8 and 9 are formed at the bottom, the top and the front of the recess 6. The head base plate 4 is secured to a plurality of bosses 11 extending from a wall 10 of the recess 6. The head base plate 4 having a flattened profile has a pair of parallel flat surfaces 12 and 13 formed thereon and has a circular positioning hole 14 and an elliptic positioning hole 15 formed therein (refer to FIG. 8). An ink jet head which will be hereinafter described is formed on the flat surface 13 of the head base plate 4, and the circumference of nozzles in a front surface of the ink jet head is covered with a face plate 16. Further, three openings 17 are formed in the cartridge cover 5 such that part of the head base plate 4 are exposed therethrough as shown in FIGS. 5 and 9.

Figure 6:
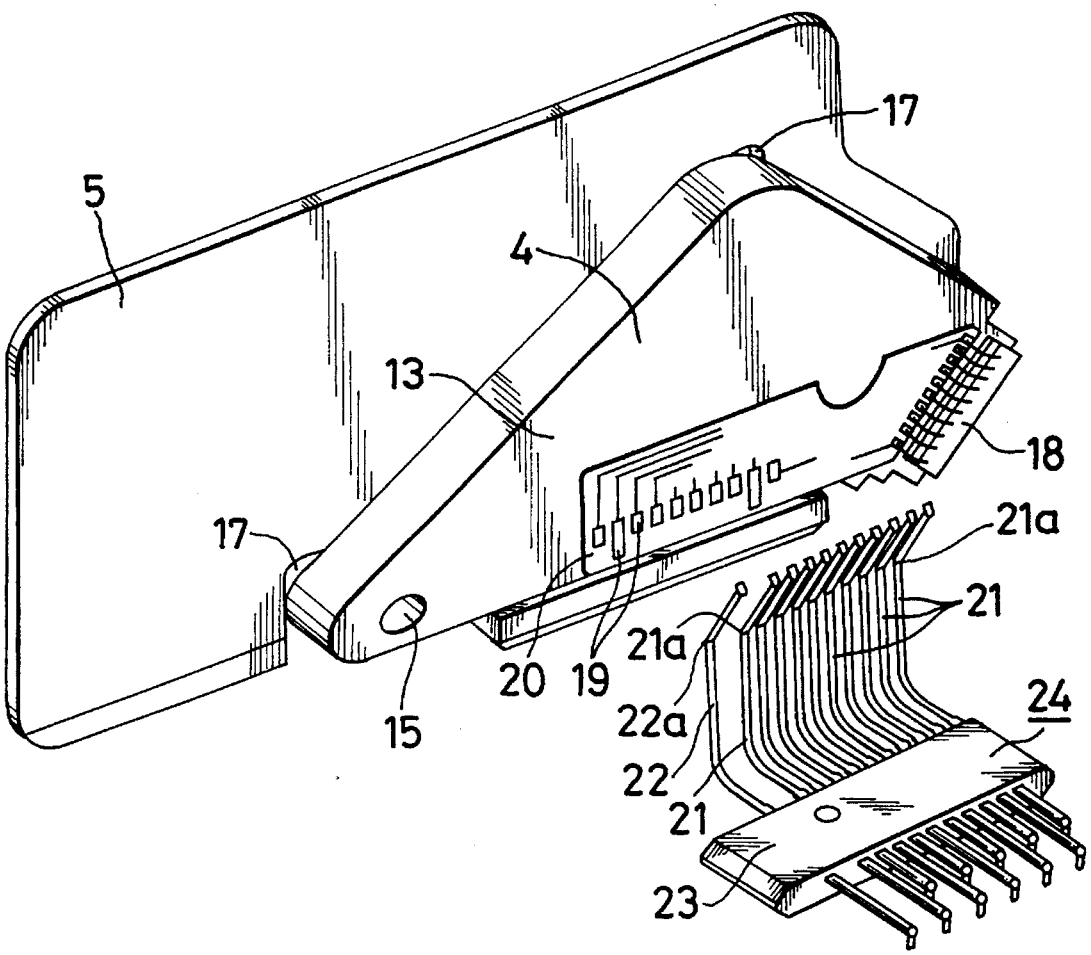
FIG. 6 is an exploded perspective view illustrating a positional relationship between contacts of the head base plate and connection elements of the connector.

As shown in FIG. 6, an ink jet head 18 and a wiring board 20 having a large number of contacts 19 are provided on the flat surface 13 of the head base plate 4. Further, a connector 24 wherein a large number of connection elements 21 and a single connection element 22 are embedded in an insulating member 23 is provided. Each of the connection elements 21 has a contact portion 21*a* extending substantially in an L-shaped profile and resiliently contacting with a corresponding one of the contacts 19 while the connection element 22 has a contact portion 22*a* extending substantially in an L-shaped profile and resiliently contacting with a metal surface of the head base plate 4. As shown in FIG. 4, rear ends of the connection elements 21 and 22 are soldered to a base plate 23*a*, which is in turn connected to a second carriage frame 32 which will be hereinafter described.

Figure 7:
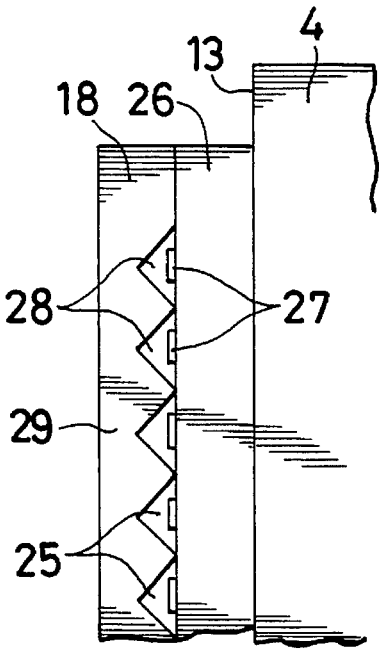
FIG. 7 is a front elevational view showing, in an enlarged scale, an end of an ink jet head.

As shown in FIG. 7, the ink jet head 18 includes a pair of silicon substrates 26 and 29 joined in an overlapping condition to the inner flat surface 13 of the head base plate 4. A large number of heat generation elements 27 serving as ink discharging means are formed on the silicon substrate 26. Meanwhile, a large number of ink reservoirs 28 in the form of grooves are formed in the silicon substrate 29, and the heat generation elements 27 are positioned in the ink reservoirs 28. Opening surfaces of the extremities of the ink reservoirs 28 serve as nozzles 25 opposing to a printing medium. Further, a matrix circuit (not shown) for driving the heat generation elements 27 are formed on the silicon substrate 26.

Figure 1:
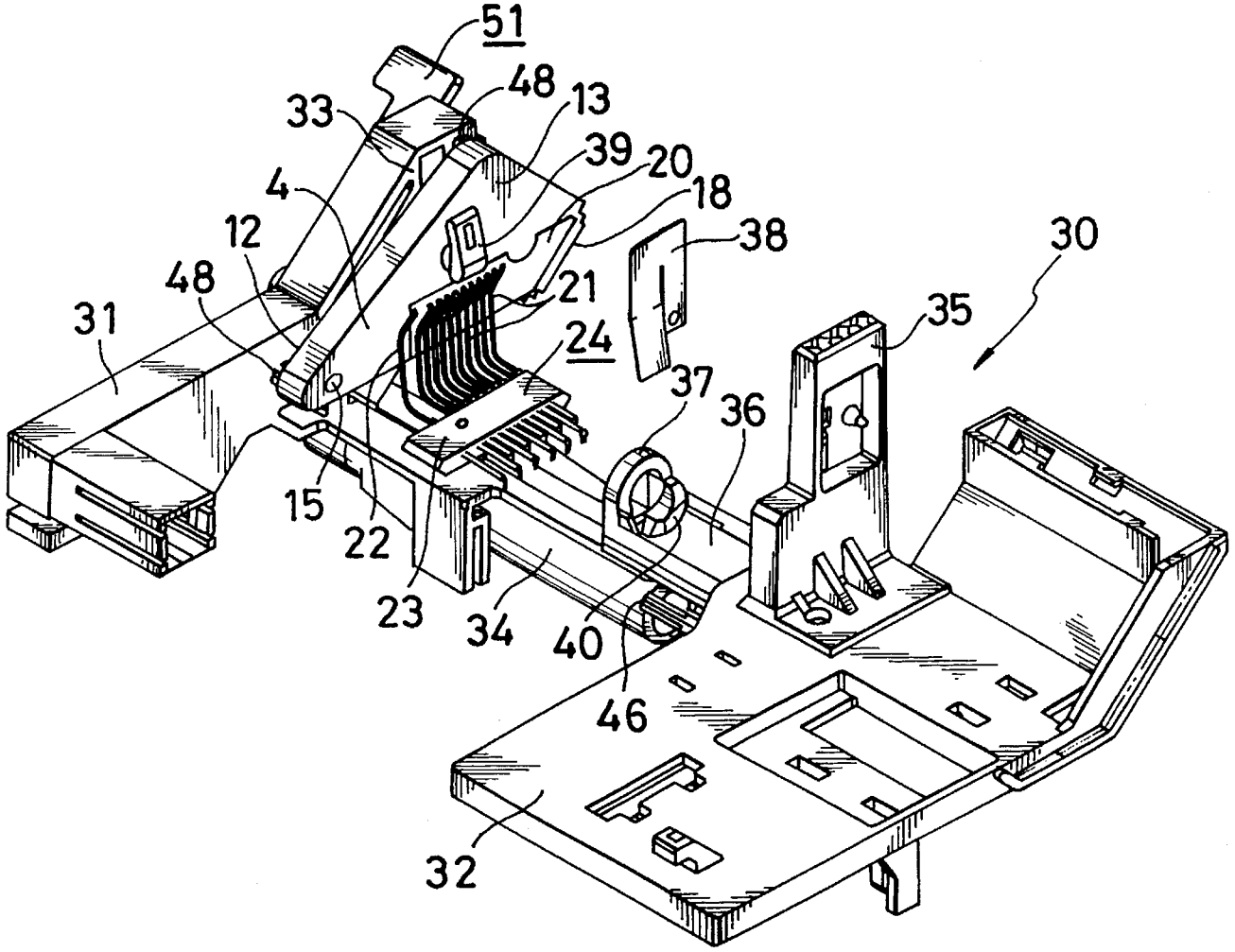
FIG. 1 is an exploded perspective view showing a head base plate and first and second carriage frames with an ink tank omitted and showing a first preferred embodiment of the present invention.

Subsequently, the structure of a carriage 30 will be described with reference to FIGS. 1 to 3. As shown in FIG. 1, the carriage 30 includes a first carriage frame 31 and a second carriage frame 32 which are both formed from an insulating resin. The first and second carriage frames 31 and 32 are fitted for sliding movement along a carrier shaft (not shown). In particular, the first carriage frame 31 has a support piece 33 and a cylindrical portion 34 formed thereon. The support piece 33 is opposed to the outer flat surface 12 of the head base plate 4 while the cylindrical portion 34 is formed contiguously to an inner surface of the support piece 33 and fitted for sliding movement on the carrier shaft. The second carriage frame 32 has a post-shaped cartridge holding portion 35 formed thereon. The cartridge holding portion 35 extends through the opening 7 and further through the opening 8 and serves as pressurizing means for pressing on the flat surface 13 of the head base plate 4. The second carriage frame 32 further has a protrusion 36 formed thereon and extending along an upper surface of the cylindrical portion 34, and an inverted U-shaped wall portion 37 formed at an end of the protrusion 36. The carriage holding portion 35 has a pressing member 39 carried at an end of a leaf spring 38 for resiliently pressing against the head base plate 4. The wall portion 37 has a spiral cam 40 formed integrally on an inner surface thereof and having an axis on a straight line which extends along a longitudinal direction of the protrusion 36 through the center of the wall portion 37.

Figure 2:
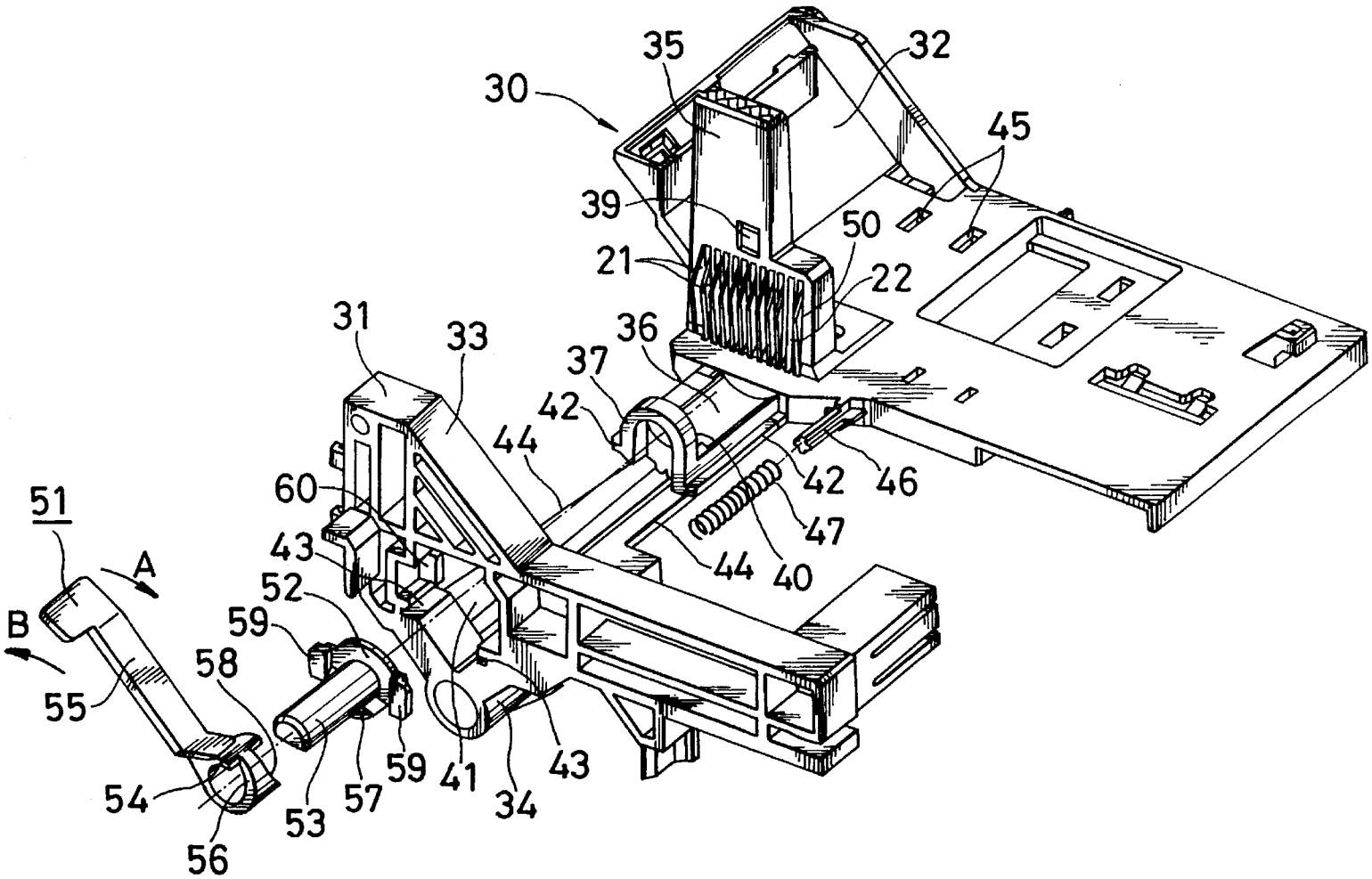
FIG. 2 is an exploded perspective view showing the first and second carriage frames and a clamp mechanism.

Further, as shown in FIG. 2, a non-circular hole 41 is formed in the support piece 33 of the first carriage frame 31, and the protrusion 36 and the wall portion 37 extend through the non-circular hole 41. A pair of grooves 43 are formed on the opposite sides of the non-circular hole 41, and a pair of ribs 42 formed on the opposite sides of the protrusion 36 are received for sliding movement in the grooves 43. Further, a pair of ribs 44 are formed on the first carriage frame 31 on the opposite sides of the cylindrical portion 34. The second carriage frame 32 has a pair of channel-shaped pawls 45 and a shaft 46 formed thereon. The pawls 45 hold the ribs 44 for sliding movement thereon. The shaft 46 extends laterally from the second carriage frame 32 and has a spring 47 fitted thereon for pressing against the support piece 33.

Figure 3:
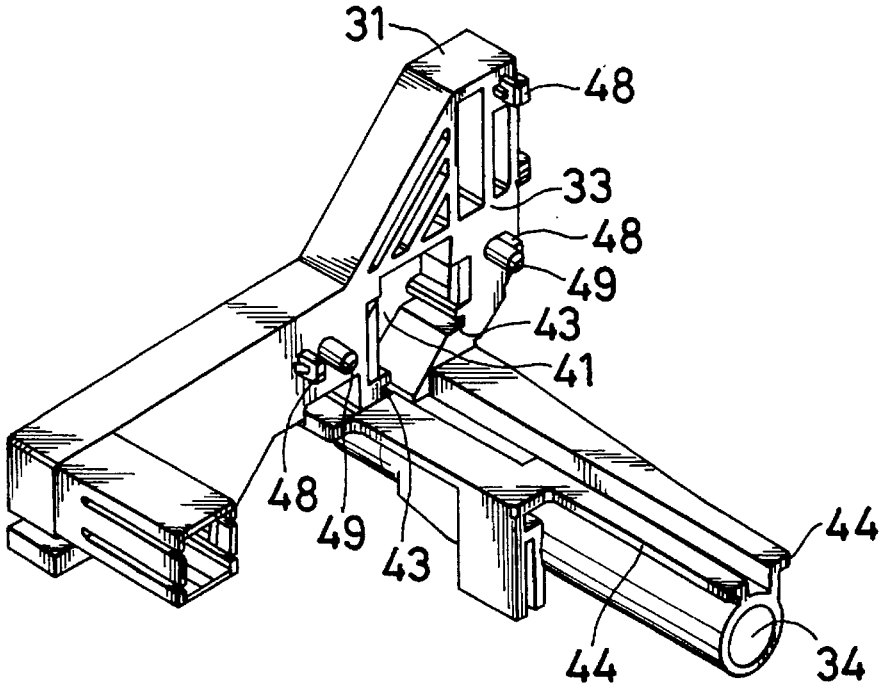
FIG. 3 is a perspective view showing the first carriage frame.

Further, as shown in FIG. 3, three projections 48 and two positioning portions 49 are formed to project on the inner surface of the support piece 33 of the first carriage frame 31. The projections 48 contact with the flat surface 12 of the head base plate 4 remote from the contacts 19, and the positioning portions 49 are adapted to be fitted in the positioning holes 14 or 15 formed in the head base plate 4. Tips of the three projections 48 are positioned within a predetermined plane substantially perpendicularly to the carrier shaft described hereinabove, thereby constituting first positioning means. Further, the tips of two positioning portions 49 are located within a predetermined plane parallel to the carrier shaft, thereby constituting second positioning means.

The second positioning means can position the front surface of the ink jet head in which nozzles are formed in a direction parallel to a recording medium (not shown) held at an appropriate printing position.

Figure 11:
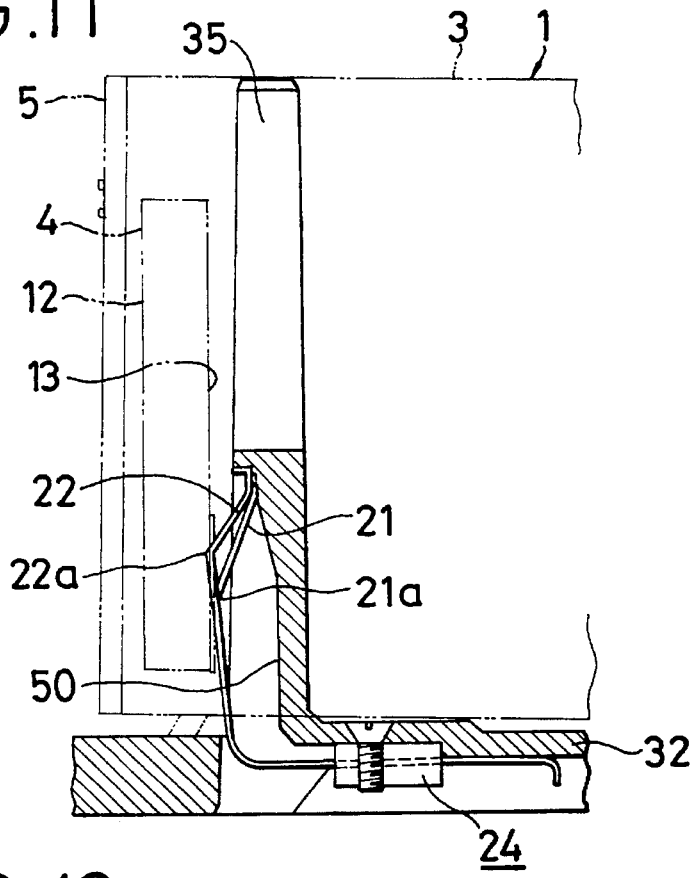
FIG. 11 is a longitudinal sectional front elevational view showing a supporting structure of the second carriage frame for the connector.
Figure 12:
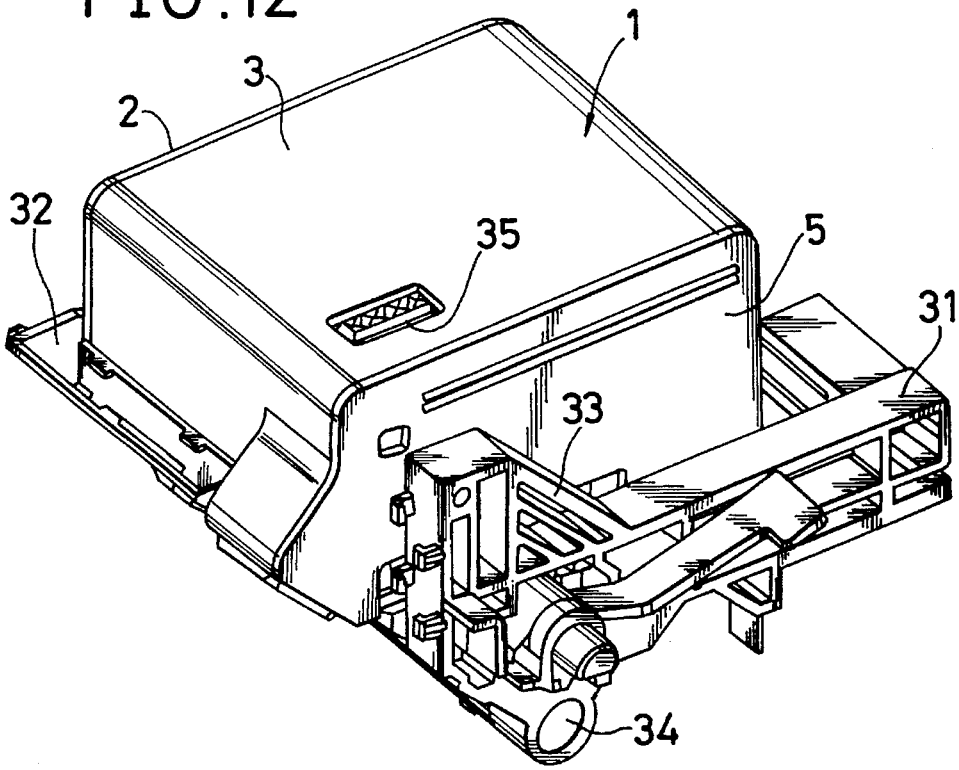
FIG. 12 is a perspective view as viewed from the front illustrating a condition wherein the entire ink cartridge is being mounted onto the carriage.

A vertical sectional front elevational view of part of the cartridge holding portion 35 of the second carriage frame 32 is shown in FIG. 11. The contact portion 22*a* of the connection element 22 for grounding is bent in such a profile that it is positioned nearer to the head base plate 4 and higher than the contact portions 21*a* of the other connection elements 21. Meanwhile, the cartridge holding portion 35 serving as an insulating member has a large number of grooves 50 formed thereon, which hold upper portions of the connection elements 21 and 22 of the connector 24 and isolate adjacent ones of the connection elements 21 and 22 from each other as shown in FIG. 2. The depth of bottom faces of the grooves 50 for holding the connection elements 21 therein is set to a dimension deeper than the depth of a bottom face of the groove 50 for holding the grounding connection element 22 therein. Even with such dimensional setting, the contact portion 22*a* of the grounding connection element 22 extends farther to the head base plate 4 than the contact portions 21*a* of the other connection elements 21. Further, while a distance substantially equal to twice the pitch of arrangement of the connection elements 21 is provided between the connection element 22 and one of the connection elements 21 nearest to the connection element 22, a groove 50 is formed also in the distance. In other words, the grooves 50 are formed in an equidistantly spaced relationship from each other, and the thickness of portions between the grooves 50 is set thin and uniform. Consequently, an otherwise possible distortion in dimension by a practical contraction upon molding is prevented.

Subsequently, a clamp mechanism 51 will be described with reference to FIG. 2. The clamp mechanism 51 includes a clamp shaft 53 having a flange 52 formed at an end thereof, and a clamp lever 55 having a cylindrical fitting portion 54 formed thereon and adapted to be fitted for pivotal motion on the clamp shaft 53. A spiral cam 56 is formed at an end of the fitting portion 54 and adapted to contact with the spiral cam 40 (refer to FIG. 1) formed on the inner surface of the wall portion 37. Another spiral cam 58 is formed at the other end of the fitting portion 54 and adapted to contact with a spiral cam 57 formed on an outer periphery of the clamp shaft 53 adjacent the flange 52. The cams 56 and 58 of the clamp lever 55 are formed so as to have opposite lead directions to each other. The lead directions of the cams 40 and 56 are set same as each other while the lead directions of the cams 57 and 58 are set same as each other. Further, a pair of protuberances 59 are formed on the opposite sides of the flange 52 of the clamp shaft 53. A pair of receiving surfaces 60 for receiving the protuberances 59 are formed on the first carriage frame 31 on the opposite sides of the non-circular hole 41.

In assembling the clamp mechanism 51 described above, the ribs 42 of the second carriage frame 32 are first fitted into the grooves 43 of the first carriage frame 31. Simultaneously, the ribs 44 of the first carriage frame 31 are engaged with the pawls 45 of the second carriage frame 32 to connect the first and second carriage frames 31 and 32 to each other for sliding movement along the carrier shaft. Subsequently, the wall portion 37 of the second carriage frame 32 is projected to the utmost through and from the noncircular hole 41 of the first carriage frame 31. The clamp shaft 53 on which the fitting portion 54 of the clamp lever 55 is fitted is positioned between the support piece 33 of the first carriage frame 31 and the wall portion 37. The protuberances 59 of the flange 52 are contacted with the receiving surfaces 60 of the support piece 33. In this condition, the support piece 33 is moved toward the wall portion 37 by the biasing force of the spring 47, whereupon the end of the clamp shaft 53 is fitted into the wall portion 37. Further, the clamp shaft 53 is prevented from rotation as the flange 52 and the protuberances 59 thereon are surrounded by the peripheral wall of the deformed hole 41.

Accordingly, if the clamp lever 55 is pivoted in its releasing direction (in the direction indicated by an arrow A in FIG. 2), then the spiral faces of the cams 40 and 56 are contacted with each other over the entire surfaces thereof while the spiral surfaces of the cams 57 and 58 are contacted with each other over the entire surfaces thereof. Consequently, the second carriage frame 32 is moved away from the support piece 33 by the biasing force of the spring 47. On the contrary if the clamp lever 55 is pivoted in its clamping direction (in the direction indicated by an arrow B in FIG. 2), the cam lobe of the cam 40 presses the cam lobe of the cam 56 toward the support piece 33 while the cam lobe of the cam 58 presses the cam lobe of the cam 57 toward the support piece 33. Consequently, the support piece 33 of the first carriage frame 31 is pressed toward the cartridge holding portion 35. In other words, the cartridge holding portion 35 is moved toward the support piece 33 against the biasing force of the spring 47.

With such construction as described above, when the ink cartridge 1 is to be mounted onto the carriage 30, the clamp lever 55 will be pivoted in its releasing direction to increase the distance between the support piece 33 and the cartridge holding portion 35 as described above. In this condition, the support piece 33 can be moved to the utmost away from the cartridge holding portion 35 by the biasing force of the spring 47. Accordingly, the openings 7 and 8 of the ink cartridge 1 can be fitted readily with the cartridge holding portion 35 while preventing the ink cartridge 1 from interfering with the projections 48 or the positioning portions 49 (refer to FIG. 12).

In this condition, since the contact portion 22*a* of the grounding connection element 22 is positioned nearer to the head base plate 4 and higher than the contact portions 21*a* of the other connection elements 21, the contact portion 22*a* of the grounding connection element 22 is first contacted resiliently with the metal surface (grounding surface) of the head base plate 4, and then the contact portions 21a of the connection elements 21 of the connector 24 are contacted resiliently with the contacts 19 of the head base plate 4. Accordingly, even when the cartridge 1 is mounted onto the cartridge holding portion 35 while a voltage is applied to the connection elements 21, otherwise possible destruction of the matrix circuit of the silicon substrate 26 can be prevented.

Further, since the connection elements 21 and 22 are each formed from an elastic metal plate, they have large amounts of deformation, and consequently, the connection elements 21 can be contacted with certainty with the contacts 19 and the contact element 22 can be contacted with certainty with the metal surface (grounding surface) of the head base plate 4. Further, since the amounts of deformation of the connection elements 21 and 22 are large, the fatigue of them can be prevented to enhance the reliability. Besides, since such a rubber pad as is employed in conventional ink jet printers can be eliminated, the number of parts can be decreased and the cost can be reduced.

Figure 10:
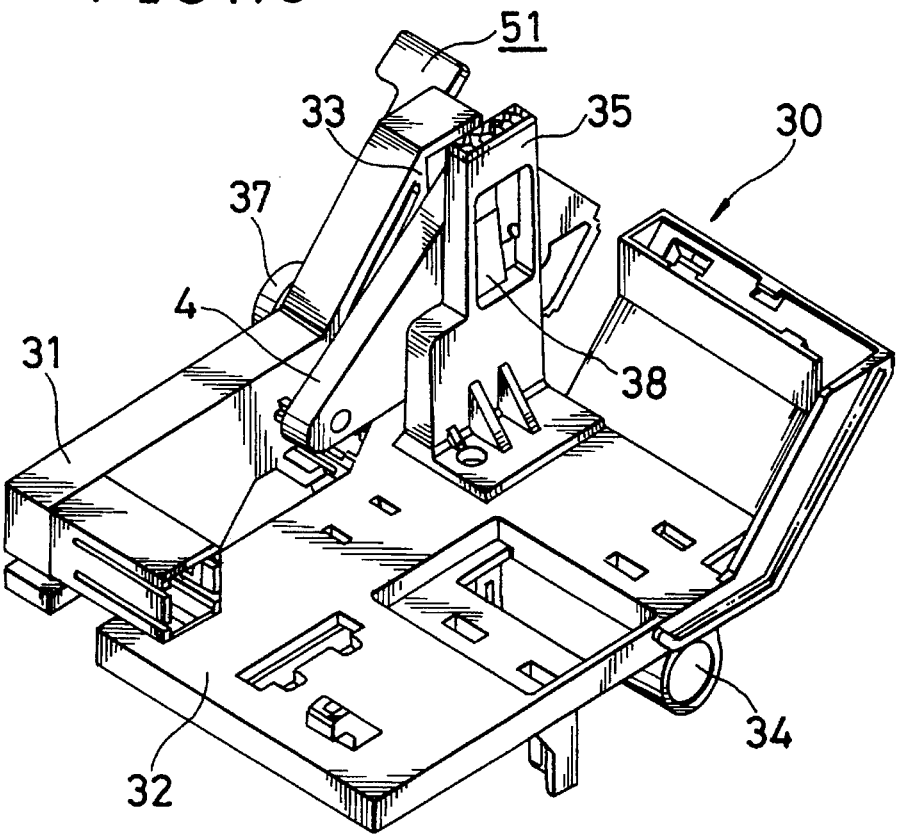
FIG. 10 is a perspective view illustrating a condition wherein the head base plate is secured to the carriage with the ink tank omitted.
Figure 13:
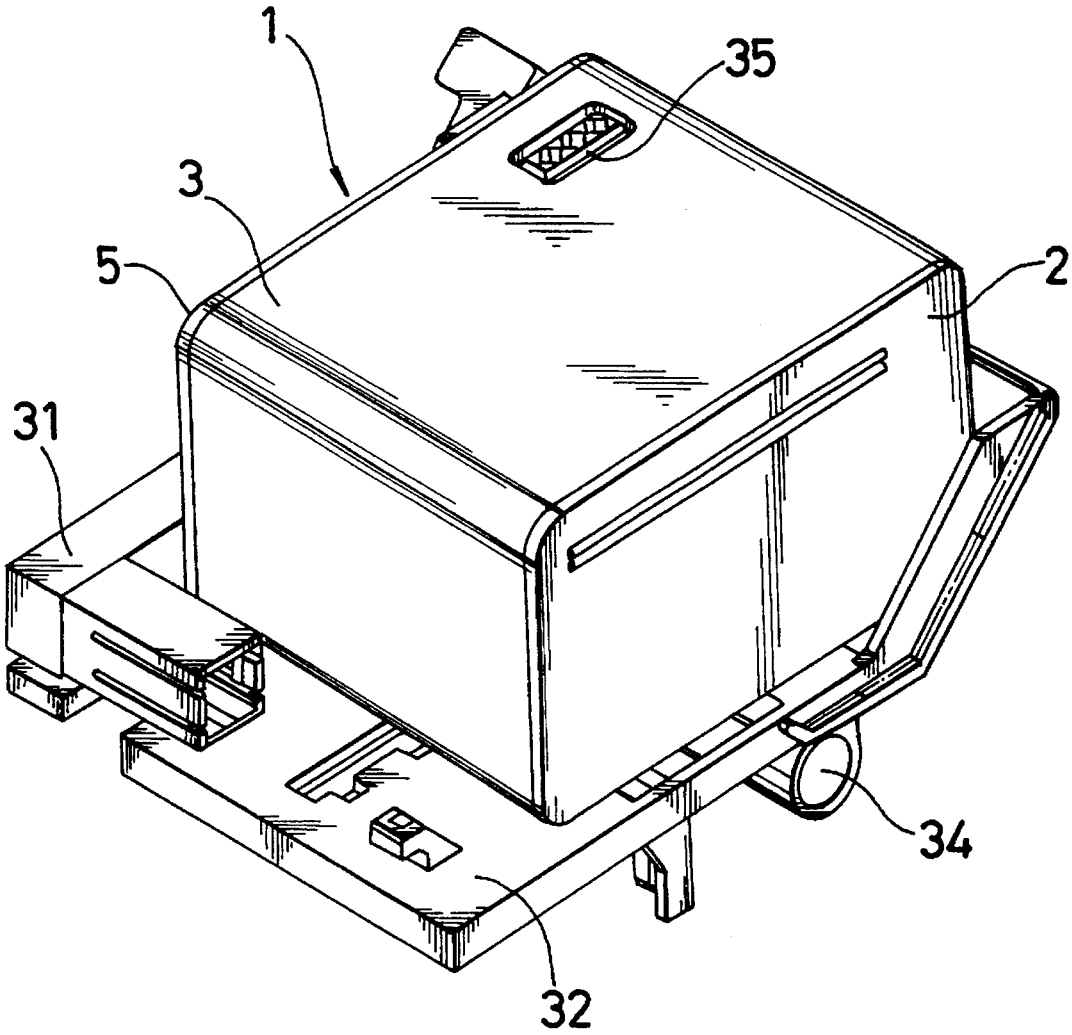
FIG. 13 is a perspective view as viewed from the rear illustrating a condition wherein the entire ink cartridge is mounted on the carriage.

Subsequently, as described hereinabove, if the clamp lever 55 is pivoted in its clamping direction, then the second carriage frame 32 is moved in the direction in which the distance between the cartridge holding portion 35 and the support piece 33 decreases as shown in FIGS. 10 and 13. Consequently, the head base plate 4 is pressed by the cartridge holding portion 35 so that it is pressed against the projections 48 of the support piece 33 through the opening 17 of the cartridge cover 5 and the positioning portions 49 are fitted into the positioning holes 14 and 15 of the head base plate 4 shown in FIG. 5 through the other opening 17.

In this condition, the head base plate 4 is positioned in the predetermined plane by the positioning portions 49 while the flat surface 12 of the head base plate 4 is contacted with the tips of the three projections 48 positioned in the same vertical plane so that the position and the verticality of the flat surface 12 of the head base plate 4 in the direction along the carrier shaft are fixed. Further, since the ink jet head 18 is formed integrally on the head base plate 4, the relative position of the ink jet head 18 to the head base plate 4 can be determined accurately. Accordingly, the nozzles of the ink jet head with respect to the recording medium can be positioned accurately by directly positioning the head base plate 4.

Further, only by increasing the distance between the support piece 33 of the first carriage frame 31 and the wall portion 37 of the second carriage frame 32 by means of the cams 40, 56, 57 and 58, the head base plate 4 can be pressed against the projections 48 of the support piece 33 with certainty to engage the positioning holes 14 and 15 with the positioning portions 49 with certainty. In this instance, since the cams 56 and 58 having the opposite lead directions to each other are formed at the opposite ends of the fitting portion 54 of the clamp lever 55 and the cam 40 for contacting with the cam 56 is formed on the wall portion 37 while the cam 57 for contacting with the cam 58 is formed on the clamp shaft 53, a large stroke can be assured for the clamp shaft 53. Consequently, a great distance can be assured between the support piece 33 and the cartridge holding portion 35, and accordingly, a mounting or dismounting operation of the ink cartridge 1 onto or from the carriage 30 can be further facilitated. Naturally, even if the cams 40 and 56 or the cams 57 and 58 in pair are omitted, the distance between the support piece 33 and the cartridge holding portion 35 can be varied by manual operation of the clamp lever 55.

Further, even if some dispersion takes place with the relative position between the support piece 33 of the first carriage frame 31 and the cartridge holding portion 35 of the second carriage frame 32, the head base plate 4 can be pressed against the support piece 33 with certainty by the pressing member 39.

Furthermore, only by mounting the ink cartridge 1 onto the carriage 30 and pivoting the clamp lever 55, the ink jet head 14 is adjusted to its accurate position. Accordingly, ink can be jetted from the ink jet head 18 in a predetermined direction toward the printing medium with certainty.

It is to be noted that it is also possible to connect the contacts 19 to the connector 29 if the connector 24 is provided on the inner surface of the support piece 33 while the contacts 19 and the ink jet head 18 are formed on the flat surface 12 of the head base plate 4 adjacent to the support piece 33 and the head base plate 4 is pressed against the support piece 33 by the cartridge holding portion 35.

Figure 14:
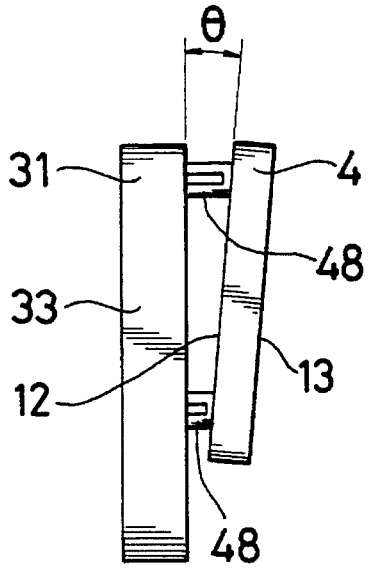
FIG. 14 is an elevational view illustrating a mounted condition of a head base plate on a support member of a first carriage and showing a second preferred embodiment of the present invention.

Subsequently, a second embodiment of the present invention will be described with reference to FIGS. 14 to 17. Same or corresponding elements to those in the first embodiment described above are denoted by same reference numerals, and therefore descriptions thereof are omitted herein (this similarly applies to the following description). As shown in FIG. 14, a pair of lower projections 48 and a single upper projection 48 are formed on a support piece 33 of a first carriage frame 31. The upper projection 48 projects by a greater length from the support piece 33 than the lower projections 48. In particular, a head base plate 4 and an ink jet head 18 are inclined by an angle of θ with respect to a vertical line perpendicular to the direction of movement of a carriage 30 (refer to FIG. 1). Accordingly, also straight lines which pass the centers of a large number of nozzles 25 formed in the ink jet head 18 are inclined by the angle of θ with respect to the vertical line similarly to flat surfaces 12 and 13 of the head base plate 4 (refer to FIG. 15). Thus, third positioning means is constituted here.

The ink jet head 18 in the present embodiment has a total of 128 nozzles 25. Accordingly, also the numbers of ink reservoirs 28 and heat generation elements 27 provided in the ink reservoirs 28 shown in FIG. 7 and serving as an ink discharging means are 128. Here, since driving of the 128 heat generation elements 27 independent of each other complicates a wiring scheme, the heat generation elements 27 are divided into groups of four elements, and a voltage is applied in a time sharing condition to the heat generation elements 27 for each group. In particular, the heat generation elements 27 are divided into groups of four elements such that #1 (first) to #4 (fourth) heat generation elements 27 make up a first group and #5 to #8, #9 to #12, . . . , and #125 to #128 heat generation elements 27 make up different groups. Also the nozzles 25 corresponding to the heat generation elements 27 are divided into groups each including four adjacent nozzles 25.

Here, where the total number (128) of the nozzles 25 is represented by N, the number (4) of those of the heat generation elements 27 which can be driven at a time by n, the time sharing number (32) by m, the period (sec) for which the heat generation elements 27 are driven in units of group by T, the pitch (inch) of arrangement of the nozzles 25 by P, the speed (inch/sec) of movement of the carriage 30 by v and the inclination angle of the nozzles 25 in units of group described above by θ, then in the case of the relationship N=mn, the inclination angle θ is determined so as to satisfy the relationship given by $$\theta=\cos^{-1}(vmT/NP)=\cos^{-1}(vT/nP)$$

Where the construction is such as described above, the case wherein, while the carriage 30 is moved in the rightward direction from its left home position, the heat generation elements 27 of the ink jet head 18 are driven in the period of T successively in order beginning with the group at the uppermost position and ending with the group at the lowermost position is considered here.

Figures 15A, 15B:
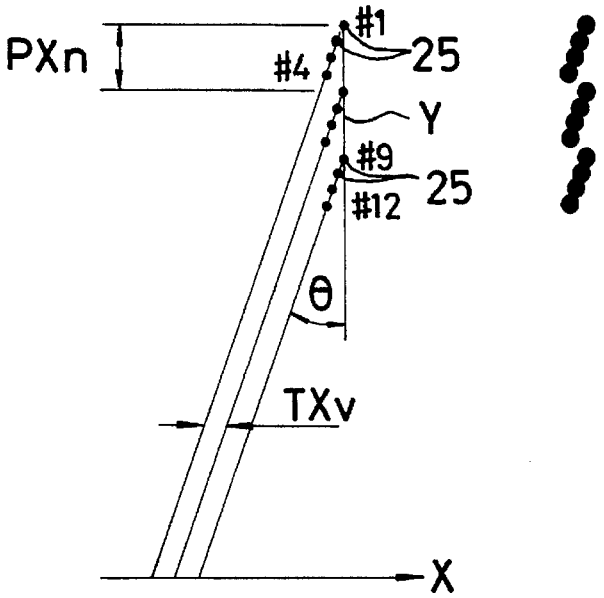
FIG. 15(*a*) is a diagrammatic view illustrating timings at which ink drops are discharged from nozzles in the apparatus of the present embodiment, and FIG. 15(*b*) is a diagrammatic view showing a result of printing by the apparatus of the present embodiment.

There is a time-lag T between the timing at which the #1 (first) to #4 (fourth) heat generation elements 27 which form the first group are driven and the timing at which the #5 to #8 heat generation elements 27 which form the second group are driven. While the carriage 30 is moved rightwardly for the time lag T, since the angle of arrangement of the nozzles 25 is inclined at the angle of θ defined by the equation given hereinabove with respect to the direction X of movement of the carriage 30, the ink discharging positions in the direction X are equal to each other in each group. FIG. 15(*a*) illustrates a manner wherein the nozzles 25 of different groups are opposed to the recording medium for the period T. As a result, while the angle of arrangement of ink drops discharged from the nozzles 25 is inclined in each group, but it is vertical as viewed in all of the groups. In this instance, since the ink drops themselves formed in one group are very small, the inclination can be ignored in practice. Accordingly, even when a straight line perpendicular to the direction X of movement of the carriage 30 is to be printed, a vertical line can be printed while the thickness of the line is fattened a little.

Figures 16A, 16B:
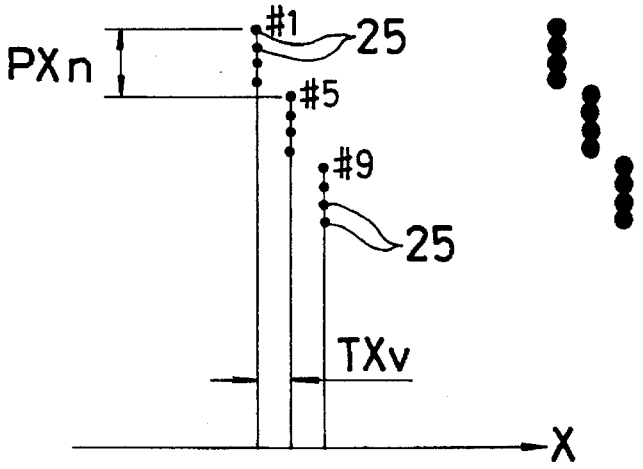
FIG. 16(*a*) is a diagrammatic view illustrating timings at which ink drops are discharged from the nozzles when the nozzles are arranged in a direction perpendicular to the direction of movement of the carriage, and FIG. 16(*b*) is a diagrammatic view showing a result of printing with the nozzles of the arrangement.

In contrast, where the head base plate 4 is fixed in a vertical condition together with the ink jet head 18 so that the nozzles 25 are arranged perpendicularly to the direction of movement of the carriage 30, since there is a time-lag T between the timing at which the #1 (first) to #4 (fourth) heat generation elements 27 which form the first group are driven and the timing at which the #5 to #8 heat generation elements 27 which form the second group are driven, when taken in units of group, the nozzles 25 advance in the direction of movement of the carriage 30 towards the lower groups as seen from FIG. 16(*a*). As a result, there is a problem that, while four dots in each group can be arranged vertically, a straight line formed by the nozzles 25 of all of the groups is inclined as seen from FIG. 16(*b*). Therefore, the advantage which is achieved by the construction of the present invention will be recognized.

Figure 17:
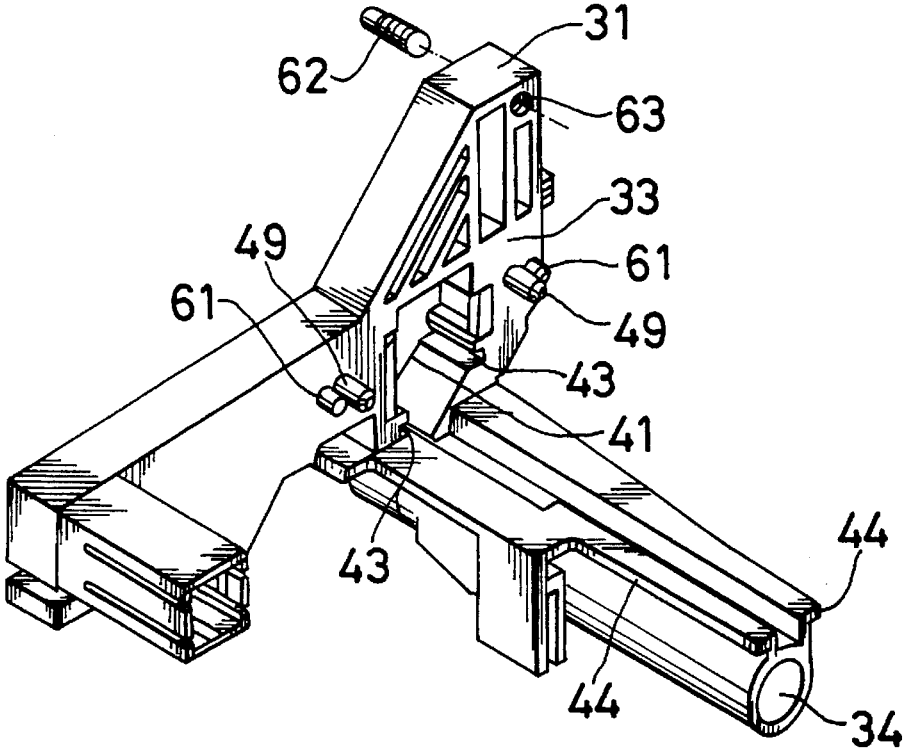
FIG. 17 is a perspective view of a first carriage frame showing a modification to the present embodiment.

It is noted that alternatively a pair of projections 61 may be formed at lower positions on the support piece 33 of the first carriage frame 31 while a screw 62 is used as a projection located at an upper position as shown in FIG. 17. In particular, by employing the structure wherein the screw 62 is screwed in a threaded hole 63 formed in the support piece 33, the inclination angle of the head base plate 4 can be adjusted. Further, if tips of the projections 61 and the screw 62 are formed spherically, then all of the tips of the projections 61 and the screw 62 can be contacted at points with the flat surface 12 of the head base plate 4 under the same condition.

Figure 18:
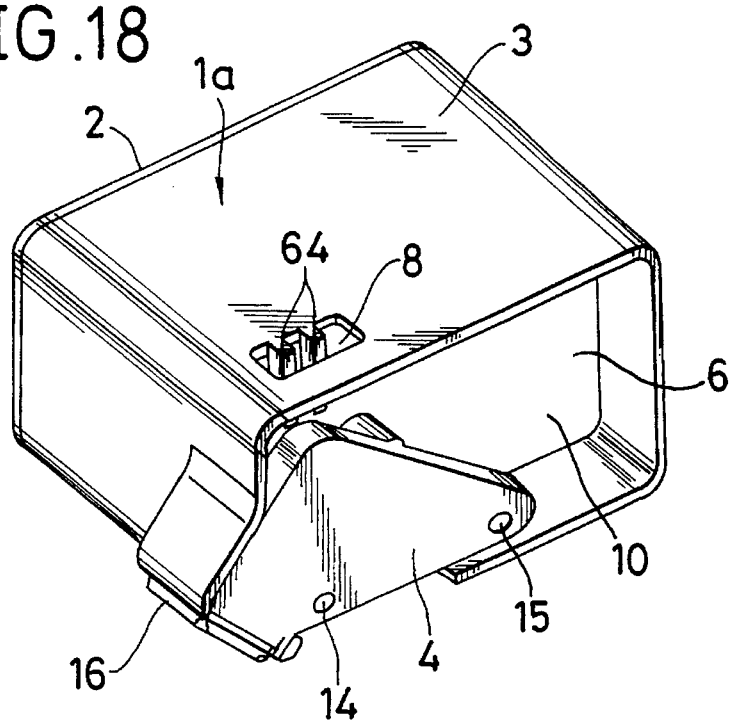
FIG. 18 is a perspective view showing the internal structure of an ink carriage and showing a third embodiment of the present invention.
Figure 19:
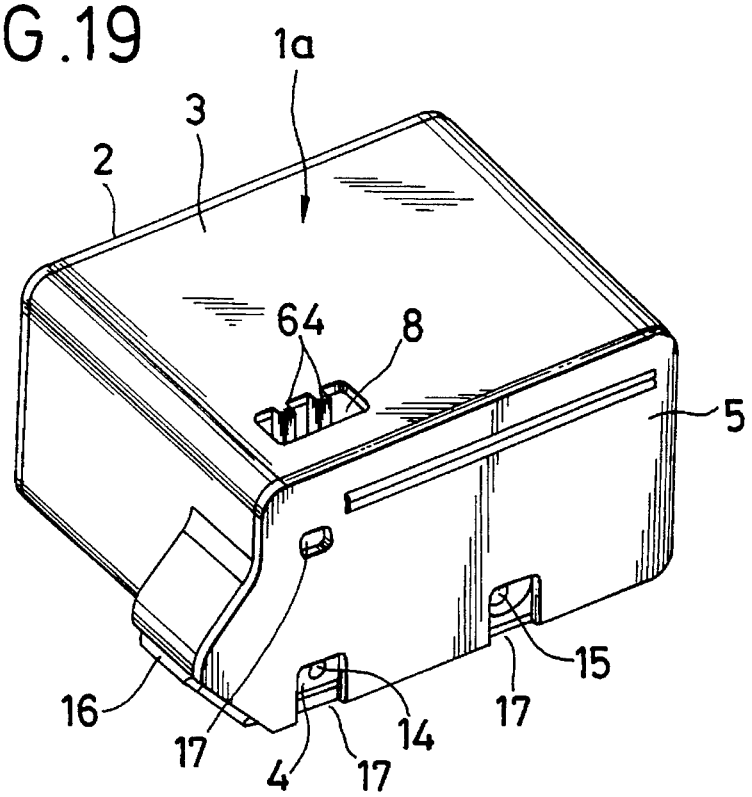
FIG. 19 is a perspective view of the ink cartridge.
Figure 20:
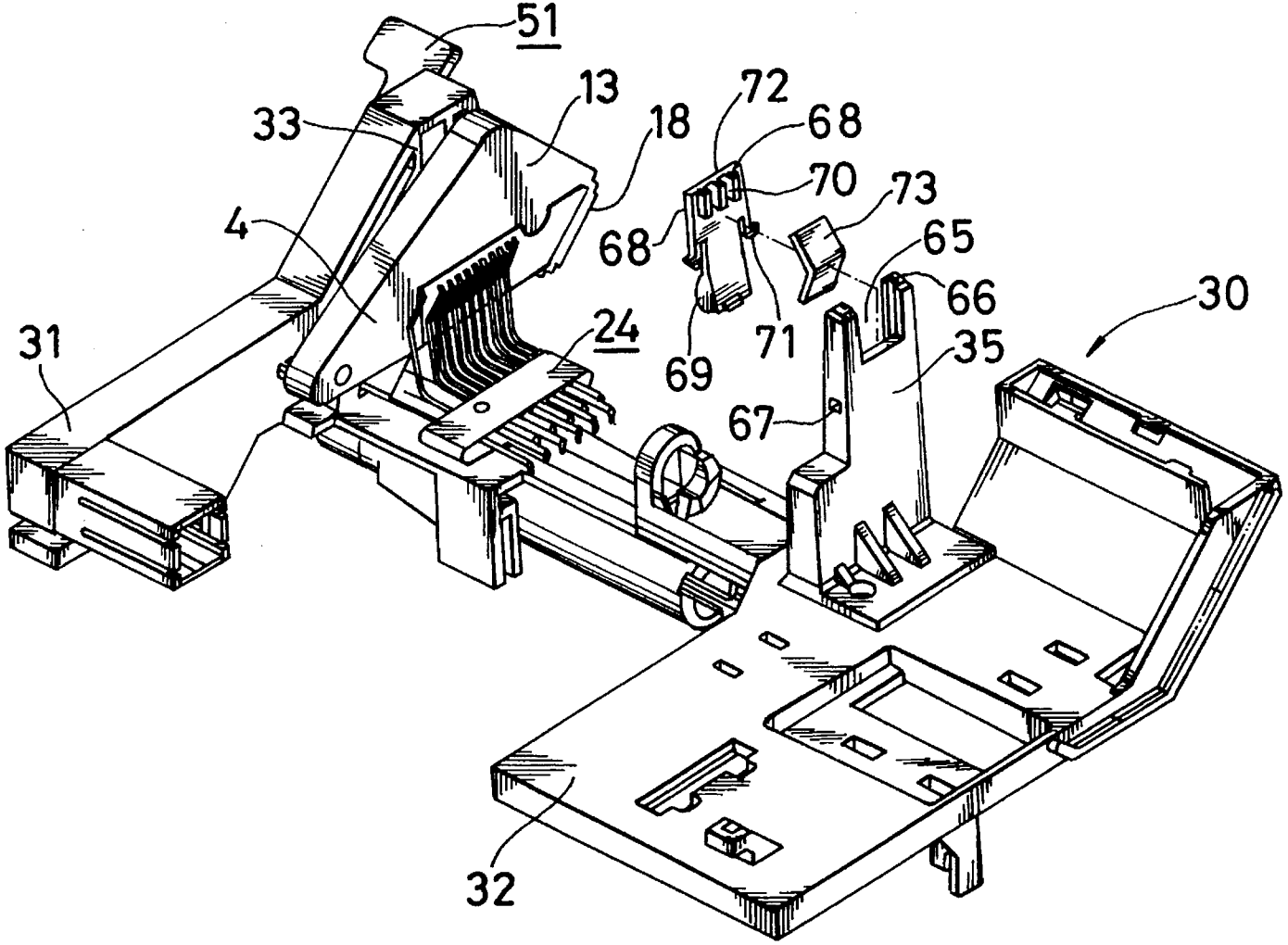
FIG. 20 is an exploded perspective view illustrating a relationship between a head base plate and first and second carriage frames with an ink tank omitted.
Figure 21:
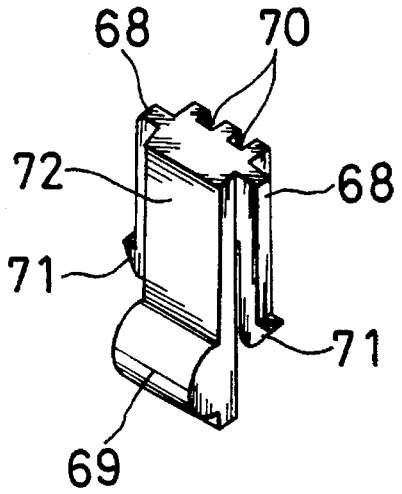
FIG. 21 is a perspective view of a chip to be mounted onto a cartridge supporting section.
Figure 22:
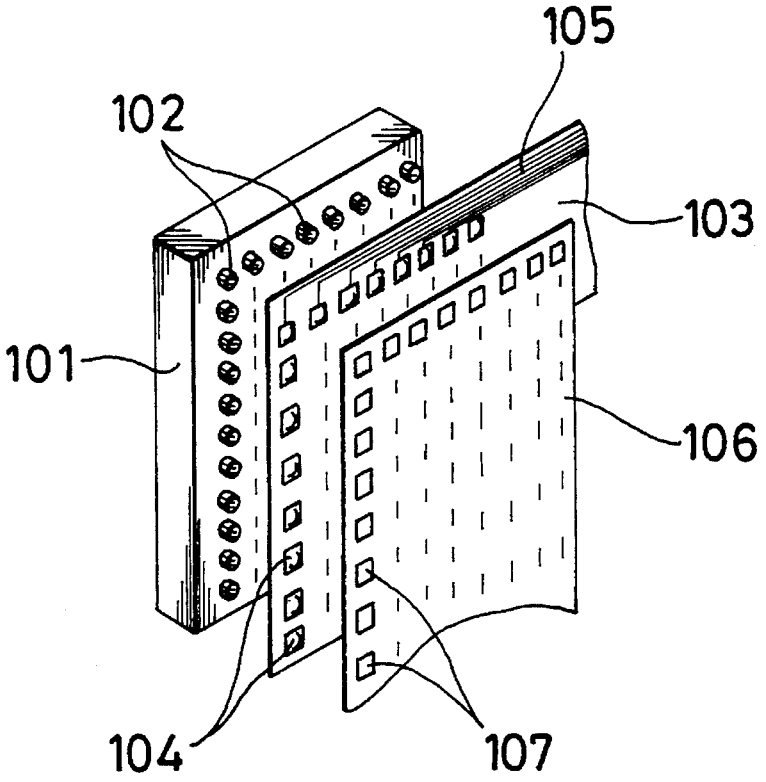
FIG. 22 PRIOR ART
FIG. 22 is a perspective view showing an example of the prior art.

Subsequently, a third preferred embodiment of the present invention will be described with reference to FIGS. 18 to 21. The present embodiment is constructed so as to allow ink cartridges of different profiles to be mounted on a carriage 30. An ink cartridge may be produced with a different or modified profile in order to allow distinction thereof from any other ink cartridge when, for example, the color of ink to be accommodated in an ink tank 3 or the number of nozzles 25 is changed. Or, ink cartridges produced by different makers may have different profiles. Here, an ink carriage la which is different only in that a pair of ribs 64 are formed in an opening 8 of the ink tank 3 as shown in FIGS. 18 and 19. In order to allow the ink cartridge 1*a* of such construction as described above to be mounted, a cartridge holding portion 35 of a second carriage frame 32 has formed thereon a recess 65, a pair of guide grooves 66 on the opposite sides of the recess 65, and a pair of engaged holes 67 on the opposite sides of the cartridge holding portion 35. Further, such a chip 72 as shown in FIG. 21 is provided. The chip 72 has formed thereon a pair of ribs 68 for fitting with the guide grooves 66 for sliding movement with a little clearance left therebetween, a pressing portion 69 for contacting with the head base plate 4, a pair of depressed portions 70 for fitting with the ribs 64 of the ink cartridge la, and a pair of engaging pawls 71 for resiliently engaging with the engaged holes 67. Reference character 73 denotes a leaf spring for biasing the chip 72 toward the head base plate 4.

With the ink jet printer of the construction described above, the chip 72 is mounted onto the cartridge holding portion 35 by inserting the ribs 68 of the chip 72 into the guide grooves 66 of the cartridge holding portion 35 and causing the engaging pawls 71 to be engaged in the engaged holes 67. The leaf spring 73 is inserted between an inner surface of the recess 65 of the cartridge holding portion 35 and the chip 72. Once the depressed portions 70 are formed on the chip 72 so as to prevent interference with the ribs 64 of the ink cartridge 1*a* in this manner, the opening 8 of the ink cartridge 1*a* can be mounted onto the cartridge holding portion 35. Further, it is also possible to mount, onto the cartridge holding portion 35 on which the chip 72 is mounted, the ink cartridge 1 shown as the first embodiment in FIG. 9.

Whichever one of the two ink cartridges is mounted, since the chip 72 is resiliently pressed to the head base plate 4 side by the leaf spring 75 by an amount corresponding to the clearance between the guide grooves 66 and the ribs 68, when the first and second carriage frames 31 and 32 are connected to each other by means of the clamp mechanism 51 as described hereinabove in connection with the first embodiment, the head base plate 4 can be resiliently pressed against the support piece 33 of the first carriage frame 31 by the pressing portion 69 of the chip 72.

The present invention has been described with reference to specific embodiments. However, other embodiments based on the principles of the present invention will be obvious to those of ordinary skill in the art. Such embodiments are intended to be covered by the claims.

What is claimed is:

1. An ink jet printer in which an ink cartridge including an ink tank and a head base plate which has an ink jet head including a plurality of ink discharging means is used, comprising:

printing means for performing printing in a main printing direction on a recording medium with ink which is selectively discharged from said ink discharging means of said ink jet head, said printing means including a carriage shaft extending in the main printing direction and a carriage mounted for sliding movement on said carriage shaft for carrying said ink cartridge thereon, said carriage including a first carriage frame and a second carriage frame;

at least three projections provided on said first carriage frame for individually contacting with at least three portions of said head base plate to position said ink discharging means of said ink jet head at predetermined positions; and pressurizing means provided on said carriage for pressing said head base plate against said projections by moving said first carriage frame and said second carriage frame along said carriage shaft.

2. An ink jet printer according to claim 1, wherein said projections include first positioning means for positioning said ink discharging means in a direction substantially perpendicular to said carriage shaft, and second positioning means for positioning said ink discharging means in a direction substantially parallel to the recording medium.

3. An ink jet printer according to claim 1, wherein said projections include first positioning means for directing said ink discharging means in a direction having a predetermined angle with respect to said carriage shaft, and second positioning means for positioning said ink discharging means in a direction substantially parallel to the recording medium.

4. An ink jet printer according to claim 1, wherein said second carriage frame has thereon a cartridge holding portion for temporarily holding the ink cartridge thereon.

5. An ink jet printer according to claim 4, wherein said pressurizing means includes a mechanism for moving said first carriage frame and second carriage frame along said carriage shaft so that said projections and said cartridge holding portion approach each other.

6. An ink jet printer according to claim 5, wherein said printing means has a plurality of resiliently deformable connection pieces provided on said cartridge holding portion, said connection pieces being contacted with contacts provided on said head base plate and connected to said ink discharging means when said first and second carriage frames are moved along said carriage shaft by said mechanism.

7. An ink jet printer, comprising:

a carriage mounted for sliding movement on a carriage shaft, said carriage including a first carriage frame and a second carriage frame;

an ink cartridge including an ink tank and a head base plate coupled to said ink tank, said head base plate having an ink jet head having a plurality of ink discharging means for individually discharging ink therefrom and a plurality of contacts individually connected to said ink discharging means;

a plurality of contact elements provided on said carriage for resiliently contacting with said contacts of said head base plate;

a support member provided on said first carriage frame and having at least three projections for individually contacting with at least three portions of said head base plate and a positioning portion for engaging with said head base plate; and pressurizing means provided on said carriage for pressurizing said head base plate toward said support member.

8. An ink jet printer according to claim 7, wherein said carriage is formed from a first carriage frame mounted for sliding movement on said carriage shaft and a second carriage frame connected for sliding movement to said first carriage frame, said support member being provided on said first carriage frame while said second carriage frame has a cartridge holding portion provided thereon for temporarily and removably holding said ink cartridge thereon, and said pressurizing means is formed from a clamp mechanism which moves said second carriage frame in a direction in which said cartridge holding portion and said support member approach each other.

9. An ink jet printer according to claim 8, wherein said second carriage frame has a wall portion provided fixedly thereon such that said wall portion extends from an inner side to an outer side through said support member provided on said first carriage frame, and said clamp mechanism is provided between said support member and said wall portion and has a cam for increasing the distance between said support member and said wall portion.

10. An ink jet printer according to claim 8, wherein said cartridge holding portion has a pressing member provided thereon for resiliently pressing said head base plate toward said support member.

11. An ink jet printer according to claim 7, wherein said support member is formed such that it extends in a direction perpendicular to a direction of back and forth movement of said carriage, and said ink jet head is formed on one of two faces in a thicknesswise direction of said head base plate which contacts with said projections formed on said support member.

12. An ink jet printer according to claim 11, wherein said nozzles of said ink jet head are arranged in a direction perpendicular to the direction of back and forth movement of said carriage.

13. An ink jet printer according to claim 12, wherein a direction of arrangement of said nozzles is inclined in accordance with a driving order of said ink discharging means.

14. An ink jet printer, comprising:

a carriage mounted for back and forth movement;

an ink cartridge removably mounted on said carriage and including an ink tank and an ink jet head coupled integrally to said ink tank and having a plurality of ink discharging means for individually discharging ink from nozzles thereof;

a wiring board provided on said ink cartridge and having thereon a plurality of contacts individually connected to said ink discharging means; and a connector mounted on said carriage and including an insulating member, a plurality of connection elements each formed from an elastic metal plate and secured at portions thereof to said insulating member for resiliently contacting with said contacts and a grounding connection element which contacts a grounding face of said ink cartridge before said connection elements contact said contacts.

15. An ink jet printer according to claim 14, further comprising an insulating element provided on said carriage and having a plurality of grooves formed thereon and adapted to receive said connection elements therein.

16. An ink jet printer according to claim 15, wherein said grooves of said insulating element have bottom faces which are individually contacted by free end portions of said connection elements to define returned positions of said connection elements.

17. An ink jet printer according to claim 14, wherein said grounding connection element has formed at a portion thereof a contact portion which extends toward said grounding face of said ink cartridge while said connection elements have contact portions which extend toward said contacts of said ink cartridge, and a depth of a bottom face of one of said connection elements in which said grounding connection element is inserted is formed smaller than the depth of bottom faces of said grooves in which said connection elements are inserted.

18. An ink jet printer according to claim 16, wherein said grounding connection element has formed at a portion thereof a contact portion which extends toward said grounding face of said ink cartridge while said connection elements have contact portions which extend toward said contacts side of said ink cartridge, and the depth of a bottom face of one of said connection elements in which said grounding connection element is inserted is formed smaller than the depth of bottom faces of said grooves in which said connection elements are inserted.

* * * * *

UNITED STATES PATENT AND TRADEMARK OFFICE

CERTIFICATE OF CORRECTION

PATENT NO. : 5,467,116

DATED : November 14, 1995

INVENTOR(S) : Shinya NAKAMURA, et al.

It is certified that error appears in the above-indentified patent and that said Letters Patent is hereby corrected as shown below:

On the title page, Item [73], the first assignee should read: --Kabushiki Kaisha TEC--

Signed and Sealed this

Twenty-sixth Day of March, 1996

Bruce Lehman

*Attest:*

BRUCE LEHMAN

*Attesting Officer*

*Commissioner of Patents and Trademarks*